United States Patent [19]

Wake

[11] Patent Number: 4,976,121

[45] Date of Patent: Dec. 11, 1990

[54] DIAL LOCK ASSEMBLY

[75] Inventor: Kiyoyasu Wake, Kawasaki, Japan

[73] Assignee: Yoshida Kogyo K. K., Tokyo, Japan

[21] Appl. No.: 414,707

[22] Filed: Sep. 29, 1989

[51] Int. Cl.[5] ..... E05B 67/38

[52] U.S. Cl. ..... 70/68; 70/23

[58] Field of Search ..... 70/23, 68, 67, 312

[56] References Cited

U.S. PATENT DOCUMENTS

| | | | |
|---|---|---|---|
| 4,244,086 | 1/1981 | Gregg | 70/68 X |
| 4,271,689 | 6/1981 | Kasai | 70/68 |
| 4,514,884 | 5/1985 | Kaneko | 70/68 X |
| 4,677,833 | 7/1987 | Scherbing | 70/68 |
| 4,756,173 | 7/1988 | Yang | 70/68 |
| 4,790,156 | 12/1988 | Yang | 70/68 |
| 4,817,769 | 4/1989 | Saliba | 70/68 X |
| 4,821,539 | 4/1989 | Steinbach | 70/68 |

FOREIGN PATENT DOCUMENTS

| | | | |
|---|---|---|---|
| 1412871 | 8/1965 | France | 70/68 |
| 1036410 | 7/1966 | United Kingdom | 70/68 |

*Primary Examiner*—Robert L. Wolfe
*Assistant Examiner*—Suzanne L. Dino
*Attorney, Agent, or Firm*—Hill, Van Santen, Steadman & Simpson

[57] ABSTRACT

A dial lock assembly is disclosed for use on a pair of slide fasteners or the like, the lock assembly comprising a master lock unit and a slave lock unit releasably engageable therewith, a dial rotatably mounted in the master lock unit and carrying indicia on its upper surface, and a lock tumblar pivotally and vertically movably mounted in the master unit and engageable with the slave unit and the dial.

8 Claims, 3 Drawing Sheets

DIAL LOCK ASSEMBLY

FIELD OF THE INVENTION

This invention relates to a lock device and has particular reference to a dial lock assembly suitable for locking together a pair of slide fastener sliders or other closure articles for security purposes.

PRIOR ART

There are known numerous dial or combination locks, a typical example of which is disclosed for instance in Japanese Utility Model Laid-Open Publication No. 57-38449 and comprises a cylindrical casing accommodating therein a latch holder and a latch plate pivotally connected thereto by a latch pin inserted in an elongated guide slot formed in the latch plate, the latch plate having an engaging portion normally urged by a latch spring in a direction to protrude out of the latch holder. Since the latch plate is not unitary with the latch pin and is pivotally supported by the pin within the latch holder, the prior art lock device necessarily involves numerous component parts that would require prolonged length of time for assembling. It has further drawbacks in that the latch pin is prone by sheer oversight to become disengaged from the latch holder, in that the latch mechanism is difficult to be assembled in a limited space in the casing and in that the latch plate is difficult to be designed structurally simple and with sufficient mechanical strength.

SUMMARY OF THE INVENTION

With the foregoing drawbacks of the prior art in view, the present invention seeks to provide an improved dial lock assembly which can be assembled with utmost ease and which incorporates a latch mechanism of sufficient mechanical strength operatively mounted in place wherein a limited, relatively small space in a lock casing.

The above and other objects and features of the invention will be more apparent from the following detailed description taken in conjunction with the accompanying drawings. Like reference numerals refer to like or corresponding parts throughout the several views.

DETAILED DESCRIPTION

Figure 1:
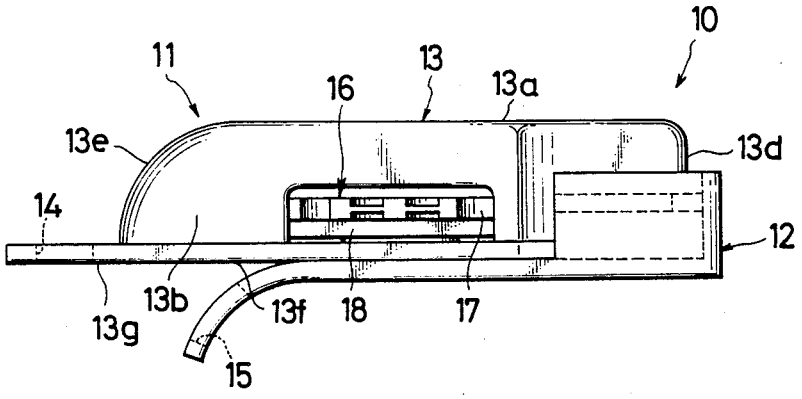
FIG. 1 is a side elevational view of a dial lock assembly embodying the invention.
Figure 2:
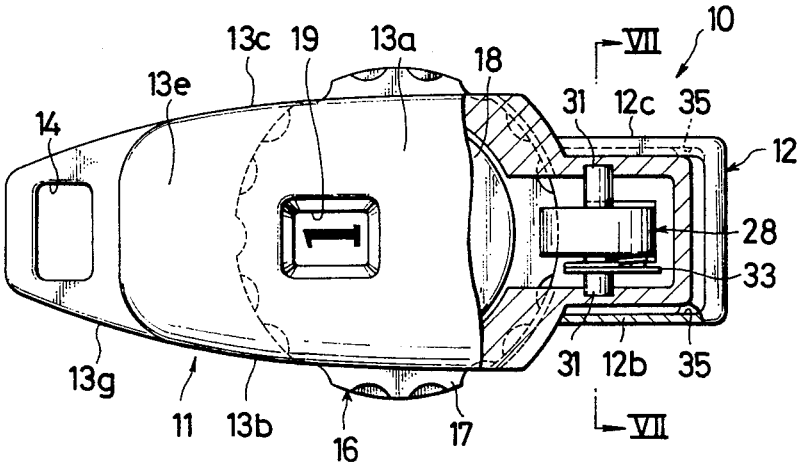
FIG. 2 is a partly sectional plan view of the lock assembly of FIG. 1.

Referring now to the drawings and FIGS. 1 and 2 in particular, there is shown a dial lock assembly generally designated at 10 which comprises a master lock unit 11 and a slave lock unit 12 releasably engaged therewith.

Figure 4:
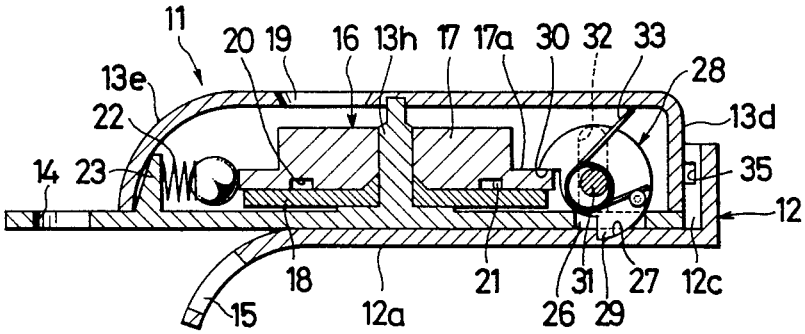
FIG. 4 is a longitudinal cross-sectional view of the lock assembly showing the same in locked position.
Figure 5:
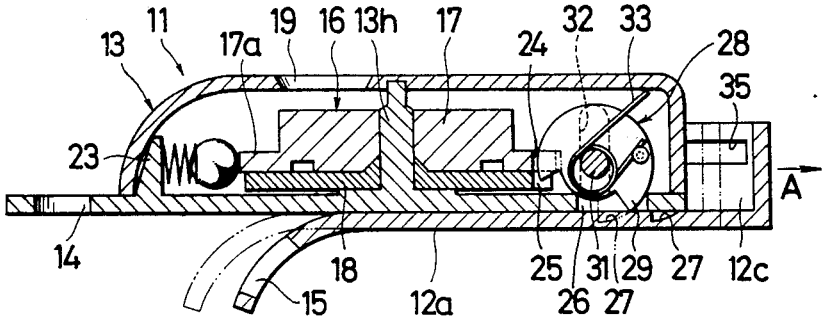
FIG. 5 is a view similar to FIG. 4 but showing the lock assembly about to be disassembled.
Figure 6:
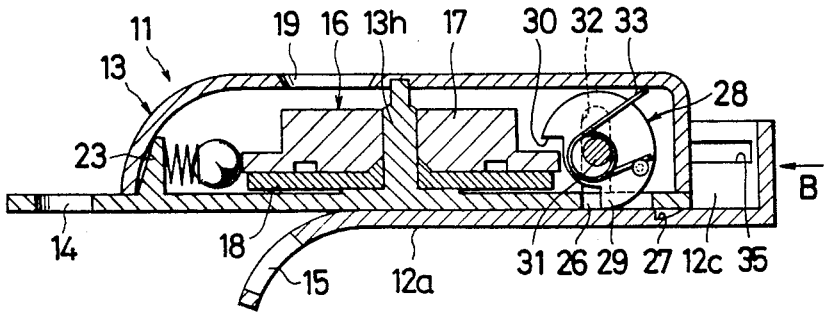
FIG. 6 is a view similar to FIG. 5 but showing the lock assembly about to be reassembled.
Figure 7:
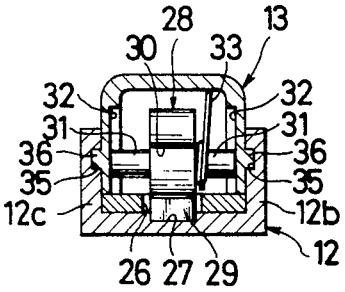
FIG. 7 is a transverse cross-sectional view taken on the line VII—VII of FIG. 2.

The master lock unit 11 comprises a casing 13 accommodating therein the various operative parts that are better shown in FIGS. 4, 5 and 6. The casing 13 is formed by a top wall **13*a*, side walls 13*b*, 13*c*, an upright front end wall 13*d*, an arcuate rear end wall 13*e* and a base wall 13*f*. The base wall 13*f* has an extension 13*g* extending rearwardly from the casing 13 and having an opening 14 for connecting the master lock unit 11 for example to a slider for slide fastener. A similar opening 15 is formed in the rear end of the slave lock unit 12**.

A support pin **13*h* is formed integrally with and extends vertically centrally of the base wall 13*f* with its tip end fixedly secured to the top wall 13*a* of the casing 13 as better shown in FIGS. 4, 5 and 6**.

A dual dial 16 comprises a first dial 17 and a second dial 18 disposed in superposed relation to each other. The first dial 17 is rotatable about the pin **13*h* relatively to the second dial 18 which is also rotatably connected to the pin 13*h*. The first dial 17 is larger in diameter so as to protrude in part beyond the side walls 13*b* and 13*c* respectively as better shown in FIG. 2. The first dial 17 carries on its upper surface a set of suitable indicia such as numerical figures which are successively exposed to view through a window 19 formed in the top wall 13*a* of the casing 13 as the dial 17** is rotated.

The dial 17 has an annular groove 20 in its lower surface adapted to receive an engaging lug 21 projecting upwardly from the second dial 18, the lug 21 being engageable in abutting relation to a stopper lug (not shown) disposed in the annular groove 20.

Designated at 22 is a spring interposed between the periphery of the first dial 17 and an upright rim 23 extending integrally from the rear portion of the base wall **13*f* within the casing 13**.

The first and second dial 17 and 18 are respectively provided with notches or recesses 24 and 25 in their respective peripheries which are brought into and out of registry with each other by rotating the first dial 17 relatively to the second dial 18.

The base wall **13*f* of the casing 13 is provided adjacent its front end with an opening 26 which is registrable with a lock groove 27 formed in the base wall 12*a* of the slave lock unit 12**.

Figure 3:
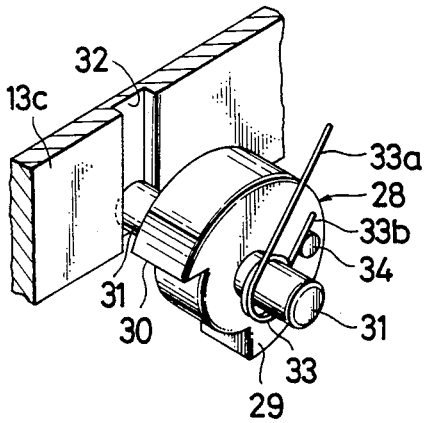
FIG. 3 is a perspective view of a lever lock tumbler forming a part of the lock assembly.

A lock tumbler 28 is disposed within the casing 13 at the front end thereof and adapted to releasably lock the slave lock unit 12 with the master lock unit 11. The tumbler 28 is generally in the form of a disc having a pair of lock pawls 29 and 30 spaced a predetermined distance apart from each other such that the first pawl 29 is fully received in the lock groove 27 while the second pawl 30 abuttingly engages a stepped upper surface **17*a* of the first dial 17 as shown in FIG. 4. As better shown in FIG. 3, the lock tumbler 28 has an integral pin 31 axially extending on opposite sides thereof and having both of its ends guidedly received in an elongated guide groove 32 formed vertically in each of the side walls 13*b* and 13*c* of the casing 13. The tumbler 28 is normally urged downwardly and clockwise by a torsion coil spring 33 wound on the axial pin 31 on one side of the tumbler 28 and having one arm 33*a* supported on the top wall 13*a* of the casing and the other arm 33*b* supported on a retaining lug 34 projecting from the tumbler 28 above the first lock pawl 29**.

As better shown, the slave lock unit 12 is cross-sectionally U-shaped and has a pair of guide grooves 35 of a predetermined length formed horizontally in opposite inner side walls **12*b*, 12*c* and adapted to receive corresponding ridges 36 projecting outwardly from the respective side walls 13*b* and 13*c* of the casing 13. This ridge and groove arrangement 35, 36 allows mounting and dismounting of the slave lock unit 12 with respect to the master lock unit 11**.

The dial lock assembly 10 is shown in FIG. 4 as in truely locked position in which the slave lock unit 12 is united with the master lock unit 11 and more specifically in which the first lock pawl 29 has been received and rested in the lock groove 27 which has been aligned in registry with the opening 26 in the base wall 13*f* and the second lock pawl 30 has been brought into abutting engagement with the stepped upper surface 17*a* of the first dial 17.

When separating the slave lock unit 12 from the master lock unit 11, this is done by rotating the first dial 17 in either direction to get a selected memorized digit or digits in the window 19 so as to bring the notch 24 of the first dial 17 into registry with the notch 25, which is what is called "provisional lock" as shown in FIG. 5. The slave lock unit 12 is pulled in the direction of "A" or toward the right as viewed in the drawings, when the tumbler 28 is rotated counterclockwise against the tension of the spring 33 with the first pawl 29 retracted away from the base of the slave unit 12 and with the second pawl 30 thrusted through the aligned notches 24, 25 of the respective dials 17, 18 until the respective ridges 36 of the master lock unit 11 are disengaged from the respective guide grooves 35 of the slave lock unit 12.

When mounting or assembling the slave lock unit 12 with the master lock unit 11, this is done by registering the respective guide grooves 35 of the slave unit 12 with the respective ridges 36 of the master unit 11 and thus pushing the slave unit 12 in the direction of "B" or toward the left as viewed in the drawings, in which instance the first lock pawl 29 is lifted in sliding contact with the base wall 12*a* of the slave unit 12, causing the tumbler 28 to move upwardly along the vertical guide grooves 32 in the casing 13. This master and slave coupling can be effected regardless of whether the lock tumbler 28 is held in "true lock position" as shown in FIG. 4 or in "provisional lock position" as shown in FIG. 5, the two respective lock positions being selectively obtained by handling the dial 17.

The dial lock assembly 10 according to the invention may be applied, though not limited, to a pair of sliders for slide fastener by connecting the master lock unit 11 to one such slider and the slave lock unit 12 to the other slider.

Many changes and modification may be made in the specific form and construction herein advanced without departing from the scope of the appended claims. As for an example, the ridges 36 may be formed on the slave unit 12, while the grooves 35 engageable with the ridges 36 may be accordingly formed in the master unit 11. As for another example, it is possible to operatively associate the lock assembly 10 with a key-operated device in place of the dial arrangement herein advanced.

What is claimed is:

1. A dial lock assembly comprising a master lock unit and a slave lock unit releasably engageable therewith, said master lock unit comprising a casing, a dial rotatably mounted on a support pin on the base wall of said casing, a lock tumbler pivotally and vertically movably disposed within said casing and having a first lock pawl engageable with the base wall of said slave unit and a second lock pawl engageable with said dial, said tumbler having an axial pin guidedly received in vertical guide grooves in said casing, and said tumbler being normally urged downwardly toward said base wall by resilient means.

2. A dial lock assembly according to claim 1 wherein said master unit has a ridge engageable in a horizontal guide groove in said slave unit.

3. A dial lock assembly according to claim 1 wherein said dial comprises a first dial and a second dial disposed in superposed relation thereto, said first dial being rotatable about said support pin relatively to said second dial.

4. A dial lock assembly according to claim 3 wherein said first and second dials and are provided peripherally with notches and, respectively which are registrable by rotation of said first dial.

5. A dial lock assembly according to claim 1 wherein said slave unit has in its base wall a lock groove engageable with said first lock pawl.

6. A dial lock assembly according to claim 1 wherein said dial protrudes beyond opposite sides of said casing.

7. A dial lock assembly according to claim 1 wherein said casing has a window through which a surface portion of said dial is exposed to view.

8. A dial lock assembly according to claim 1 wherein said resilient means is a torsion coil spring.

* * * * *